US005360359A

United States Patent [19]

Reynolds

[11] Patent Number: 5,360,359

[45] Date of Patent: Nov. 1, 1994

[54] PORTABLE BUOY MARKER ASSEMBLY

[76] Inventor: Larry W. Reynolds, P.O. Box 178, Clinton, Ill. 61727

[21] Appl. No.: 168,935

[22] Filed: Dec. 16, 1993

[51] Int. Cl.[5] ..... B63B 22/16

[52] U.S. Cl. ..... 441/6; 441/26

[58] Field of Search ..... 441/1, 6–28, 441/32, 33

[56] References Cited

U.S. PATENT DOCUMENTS

| | | | |
|---|---|---|---|
| 2,190,531 | 2/1940 | Kaboskey et al. | 441/24 |
| 2,572,676 | 10/1951 | Swyers | 441/6 |
| 3,212,110 | 10/1965 | Lombardo | 441/24 |
| 3,626,528 | 12/1971 | Jackson | 441/6 |
| 3,698,025 | 10/1972 | Worobel | 441/16 |
| 4,781,636 | 11/1988 | Schurr | 441/6 |
| 4,976,641 | 12/1990 | D'Amico | 441/6 |
| 5,273,468 | 12/1993 | Nichols | 441/6 |

FOREIGN PATENT DOCUMENTS

| | | | |
|---|---|---|---|
| 710089 | 5/1965 | Canada | 441/24 |

*Primary Examiner*—Edwin L. Swinehart
*Attorney, Agent, or Firm*—John R. Flanagan

[57] ABSTRACT

A portable buoy marker assembly includes an elongated hollow buoy tube having a flotation plug therein for providing flotational capability thereto, an end cap releasably attached to one end of the buoy tube and adapted for quick release therefrom, an elongated flexible line attached at one end to the buoy tube and extending through and from the buoy tube and attached at the opposite end to the end cap, and a reel attached to the flexible line and being adapted for winding a substantial portion of the length of the flexible line thereabout. The reel with the flexible line wound thereabout is positioned within the lower portion of the buoy tube and the remaining portion of the length of the flexible line is positioned in the buoy tube between the end of the reel and the end cap fitted on the lower end of the buoy tube. A weighted object is mounted on the remaining portion of the flexible line. Also, a lanyard is attached to the buoy tube for attachment to diving equipment.

20 Claims, 1 Drawing Sheet

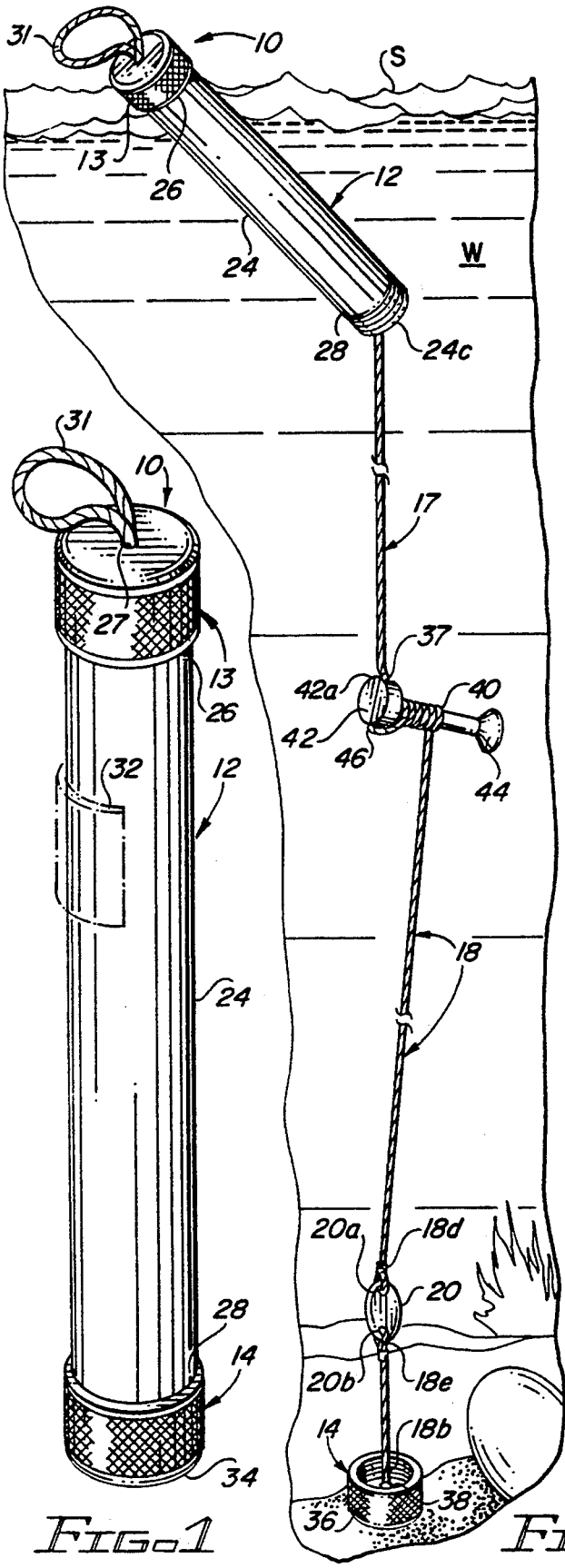
FIG. 1
FIG. 3
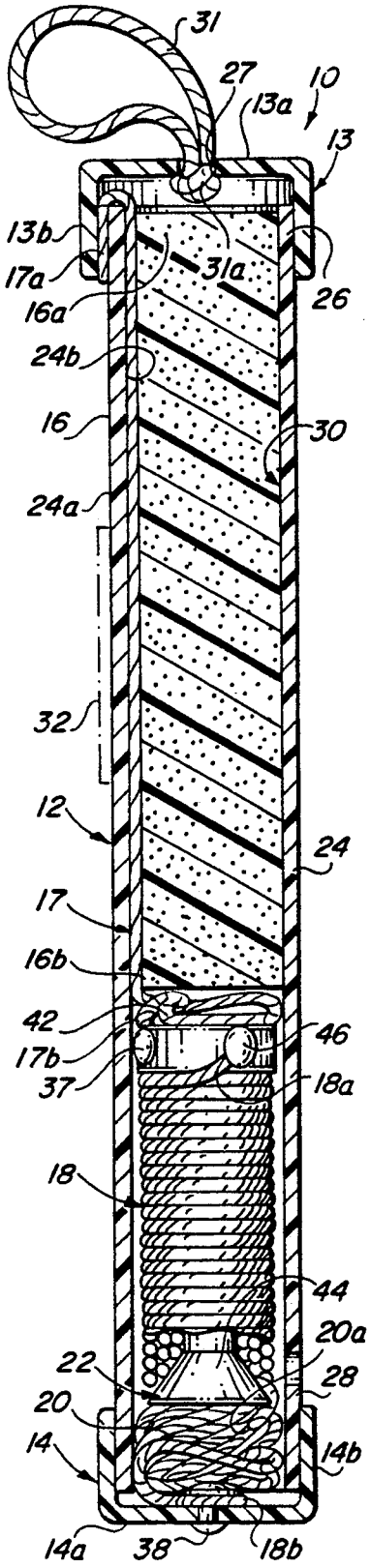
FIG. 2

PORTABLE BUOY MARKER ASSEMBLY

BACKGROUND OF THE INVENTION

1. Field of the Invention

The present invention generally relates to flotational marker assemblies and, more particularly, is concerned with a portable buoy marker assembly.

2. Description of the Prior Art

Flotational markers are important components of successful search and rescue operations in rivers and other bodies of water. The accurate location of drowning victims and of lost equipment and other items requires marking devices capable of maintaining proper flotational, stationary positions in varying bodies of water.

A variety of flotational marking devices have been proposed over the years to meet the above-described needs. Representative examples of such devices are the ones disclosed in U.S. Pat. No. 2,572,676 to Swyers, U.S. Pat. No. 3,626,528 to Jackson, U.S. Pat. No. 4,781,636 to Schurr, and U.S. Pat. No. 4,976,641 to D'Amico. Each of these devices may be utilized by boaters in their various operations, with the Jackson and D'Amico devices also being particularly designed for utilization by divers.

The Swyers and Schurr devices are each fairly complex in design and construction, thus are probably rather expensive to manufacture. The Jackson and D'Amico devices are each basically simple in design, utilizing a weighted object attached to one end of a line to stabilize the position of the flotational marker in a body of water. The opposite end of line is attached to and wound about a reel. The Jackson device encloses the reel within the internal cavity of the flotational marker. The D'Amico device includes the reel as one of the interconnected elements forming the outer surface of the device.

Efficient operation of the Jackson device presupposes the smooth, continual release of the line from the reel enclosed therein. Such line and reel arrangement is somewhat problematical. The lower deployed portion of the line could easily become snagged on an object, so as to hinder further smooth release thereof from the reel. Such line obstruction would consequently hinder proper rise of the flotational marker to the surface of the water as well.

Proper functioning of the D'Amico device depends principally on the self-ejecting feature of the weighted object disposed thereon. Should such weighted object fail to eject sufficiently from the device, or should the ejected object become quickly blocked by an obstacle, the line and reel features will not become operative.

Consequently, a need exists for a flotational marker of simple design and construction for inexpensive manufacture and for ease in use by both boaters and divers. The device should provide efficient line releasability features such that the device can be quickly stabilized in a stationary flotational position to ensure accurate marking capability.

SUMMARY OF THE INVENTION

The present invention provides a portable buoy marker assembly designed to satisfy the aforementioned needs by avoiding the drawbacks of the prior art without introducing other drawbacks. Instead, the portable buoy marker assembly of the present invention provides expanded capabilities not available in the prior art devices.

One capability is the simplicity in design and construction of the portable buoy marker assembly for inexpensive manufacture and easy use by both boaters and divers. A second capability is the simple releasability feature of the end cap attached to the buoy tube. A third capability is the line and reel arrangement within the buoy tube such that both are ejected almost simultaneously therefrom upon release of the end cap from the buoy tube. Such capability greatly enhances the proper playing out of the line through the water, thereby promoting the rise of the buoy tube to the water's surface as well.

Accordingly, the present invention is directed to a portable buoy marker assembly which comprises an elongated hollow buoy tube having opposite upper closed and lower open ends, a foam body or plug disposed in the buoy tube for providing a flotational capability for the assembly, a reel disposed in the buoy tube below the foam body, a first section of flexible line attached at one end to the buoy tube and at an opposite end to the reel, a second section of flexible line of substantially greater length than the first section of line and attached at one end to the reel and adapted for releasable winding thereabout, and a lower end cap releasably attached to the lower open end of the buoy tube for loosely retaining the reel and wound line therein and for providing quick release and removal therefrom. The second section of flexible line also has an opposite end which is attached to the lower end cap.

The buoy tube is a hollow body having a sidewall extending between the upper closed end and lower open end. The upper closed end includes an upper end cap fixedly attached to the upper end of the tube. The upper end cap has a small aperture defined therethrough with a flexible lanyard anchored to the upper end cap and extending through the aperture and from the buoy tube. The upper end of the first section of line is captured between the upper end cap and a portion of the buoy tube sidewall disposed adjacent thereto.

The sidewall of the buoy tube defines an internal cavity extending between the closed upper end and the open lower end. The foam plug is positioned within the internal cavity of the buoy tube so as to abut an inner surface of the sidewall and terminate adjacent the upper closed end of the buoy tube but spaced from the lower open end thereof.

The second section of flexible line extends through the buoy tube alongside the foam plug. The reel has a middle portion for winding the second section of flexible line thereabout and a pair of opposite end portions attached to opposite ends of the middle portion and being larger in diameter than the middle portion for maintaining the flexible line between the opposite end portions of the reel. A substantial portion of the length of the second section of flexible line is wound about the reel and the reel is positioned within the lower portion of the buoy tube. A remaining portion of the length of the second section of flexible line that is not wound about the reel is positioned below the reel in the buoy tube between the end of the reel and the end cap releasably attached on the lower end of the buoy tube. A weighted object is attached to the remaining portion of the flexible line and positioned within the lower portion of the buoy tube between the end of the reel and end cap.

The portable buoy assembly is utilized by releasing the lower end cap from attachment with lower end of the buoy tube. Upon such release, the end cap is tossed by hand towards the location to be marked. By the attachment of the end of the second section of flexible line with the lower end cap, the second section of line, weighted object and reel fall away from the buoy tube in the direction of the end cap. The weighted object attached to the second section of flexible line tends to propel and permit the lower end end cap to descend in the body of water toward the bottom, thereby providing stabilizing capability to maintain the second section of flexible line in a stationary position. The release of a substantial portion of the length of the second section of flexible line almost simultaneously from the buoy tube permits proper playing out of line such that the buoy tube will rise to the surface of the water and remain there in a substantially stationary flotational position.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1 is a perspective view of a portable buoy marker assembly of the present invention, shown in a stored position.

FIG. 2 is an enlarged longitudinal sectional view of the portable buoy marker assembly, showing the components of the assembly in a stored position.

FIG. 3 is a perspective view of the portable buoy marker assembly in a deployed position in a body of water.

DETAILED DESCRIPTION OF THE INVENTION

Referring to the drawings, and particularly to FIG. 1, there is illustrated a portable buoy marker assembly, generally designated 10, of the present invention. The portable buoy marker assembly 10 basically includes a hollow buoy tube 12, an upper end cap 13, a lower end cap 14, a flotation plug 16, a first section of flexible line 17, a second section of flexible line 18, a weighted object 20, and a reel 22.

Referring further to FIGS. 1–3, the buoy tube 12 is an elongated hollow cylindrical body having an endless cylindrical sidewall 24 with opposed inner and outer surfaces 24*a*, 24*b* and extending between a pair of upper and lower ends 26, 28. The endless sidewall 24 defines an internal cavity 30 in the buoy tube 12, extending between the upper and lower ends 26, 28 thereof. The upper end 26 of the buoy tube 12 is closed by the upper end cap 13 by a close frictional fit and the presence of an adhesive therebetween. The upper end cap 13 has a small central aperture 27 defined therethrough. The open lower end 28 of the buoy tube 12 is closed by the lower end cap 14 inserted thereon. The lower end cap 14 is only frictionally held thereon and can be removed by manually twisting and pulling it from the lower end 28 of the sidewall 24 when desired. The upper and lower end caps 13, 14 each has a flat end portion 13*a*, 14*a* and an annular side portion 13*b*, 14*b* surrounding and being attached to the peripheral edge of the flat end portion 13*a*, 14*a* and extending upwardly therefrom. Preferably, the end portion 13*a*, 14*a* and side portion 13*b*, 14*b* of the respective end cap 13, 14 are integrally formed and connected together.

The assembly 10 also includes a flexible lanyard 31 extending through the aperture in the upper end cap 13 and anchored to thereto by a knot 31*a* tied in the ends of the lanyard 31 inside of the upper end cap 13. The knot 31*a* will abut the inside of the flat end portion 13*a* of the upper end cap 13 around the aperture 27 and prevent the lanyard 32 from being pulled out of the upper end cap 13. The lanyard 31 is attachable to a diver's equipment (not shown) for transport of the buoy marker assembly 10 on diving expeditions.

Optionally, the buoy tube 12 can have a releasable fastening means 32 attached to the outer surface 24*b* thereof which is adapted for releasable attachment to complementary fastening means (not shown) disposed on a structure in a boat. The fastening means 32 on the buoy tube 12 and the complementary fastening means on the boat preferably are hook and loop fastening patches, typically made of a material commercially sold under the trademark Velcro. By attachment together of the fastening means, the buoy marker assembly 10 may be transported on the boat for easy access to and efficient use thereof as needed.

Referring particularly to FIG. 2, the flotation plug 16 is preferably cylindrical in configuration to complement the cylindrical shape of the internal cavity 30 of the buoy tube 12. The plug 16 has upper and lower ends 16*a*, 16*b* and is made of a suitable foam material, such as polyurethane, to provide flotational capability for the buoy tube 12. The plug 16 is positioned in an upper portion of the internal cavity 30 in buoy tube 12 so as to abut the inner surface 24*a* of the endless sidewall 24 thereof and such that the upper end 16*a* of the plug 16 is disposed adjacent to the upper end 26 of the buoy tube 12 and the upper end cap 13, as seen in FIG. 2.

Referring to FIG. 2, the first section of flexible line 17 has a pair of opposite ends 17*a*, 17*b*. The upper end 17*a* is attached to the upper closed end 26 of the buoy tube 12 by being captured between the annular side portion 13*b* of the upper end cap 13 and a portion of the upper end 26 of the buoy tube sidewall 24 disposed adjacent to the first section of line 17. The first section of line 17 extends through the buoy tube 12 adjacent to the interior of the sidewall 24 thereof alongside the plug 16 as seen in FIG. 2 and terminates at its lower end 17*b* extending below the plug 16.

Referring further to FIGS. 2 and 3, the second section of flexible line 18 is of a substantial length much greater than the first section of line 17 and the buoy tube 12. Also, the second section of line 18 preferably has a greater diameter than the first section of line 17. The second section of line 18 is made of a resilient material, such as filament nylon, while the first section of line 17 is a conventional fishing line. The second section of line 18 has a pair of opposite ends 18*a*, 18*b* respectively connected to the reel 22 by a fastener 37 and to the lower end cap 14 by a rivet 38 fastened through the flat end portion 14*a* of the end cap 14, as seen in FIGS. 2 and 3.

The weighted object 20 takes the form of a disk 20, made of a heavy metal and having a pair of opposite openings 20*a*, 20*b* defined therein. The object 20 is attached to the second section of flexible line 18 near the opposite lower end 18*b* thereof. Such attachment is made of looping portions 18*d*, 18*e* of the second section of line 18 respectively through the openings 20*a*, 20*b* of the disk 20 and attaching the line portions 18*d*, 18*e* so as to fasten to the object 20, as seen in FIG. 3. The second section of line 18 can be attached to the weighted object 20 in other ways.

Referring further to FIGS. 2 and 3, the reel 22 has a cylindrical-shaped middle portion 40 and a pair of opposite end portions 42, 44 attached to opposite ends of the middle portion 40. The one end portion 42 is disk-shaped and is greater in diameter than the middle portion 40. The opposite end portion 44 is of a truncated conical shape and is greater in diameter than the middle portion 40 also. The one end portion 42 is further disposed with the one fastener 37 and another fastener 46 being removably attached to a peripheral edge 42*a* thereof. The lower end 17*a* of the first section of line 17 is releasably attached to the one fastener 37 on the reel 22, while the upper end 18*a* of the second section of line 18 is releasably attached to the other fastener 46 on the reel 22. A substantial portion of the length of the first section of line 18 is wound circumferentially about the middle portion 40 of the reel 22. The reel 22 is then positioned in a lower portion of the internal cavity 30 of the buoy tube 12, below the foam plug 16, as seen in FIG. 2. Any remaining portion of second section of line 18 is then positioned below the reel 22 in the lower portion of the internal cavity 30. The lower end cap 14 is removably fastened over the lower open end 28 of the buoy tube 12 as hereinbefore described. The foam plug 16, the reel 22, and the first and second sections of line 17, 18, as described hereinbefore, are all thereby enclosed in the internal cavity 30 of the buoy tube 12. As is readily apparent in FIG. 2, the foam plug 16 is provided in the buoy tube 12 in a tight fitting relationship with the interior surface of the sidewall 24 of the tube 12, whereas the weight 20 and reel 22 are retained in the buoy tube 12 by the lower end plug 16 in a loosely contained and stored relationship within the internal cavity 30 of the buoy tube 12 between the foam plug 16 and the lower end cap 14. Thus, once the lower end cap 14 is removed, the weight 20 and reel 22 will slide and fall from the buoy tube 12 while the foam plug 16 will be retained therein.

The portable buoy marker assembly 10 is utilized in the following manner. As hereinbefore described, the buoy assembly 10 may be transported by a diver being attached to his or her equipment by attachment of the lanyard 31 thereto, or on a structure in a boat, through attachment together of releasable complementary fastening means disposed on the buoy marker assembly 10 and boat. At the time of use, the buoy marker assembly 10 is released from its attachment to the diver's equipment or the boat. The lower end cap 14 is then twisted and pulled from the lower end 28 of the buoy tube 12 and thereby released from the buoy tube 12. The lower end cap 14 is then thrown manually downwardly through the water W toward a desired location. The second section of flexible line 18, being attached to the lower end cap 14 as hereinbefore described, is projected downwardly following the path of the lower end cap 14, as seen in FIG. 3. The weighted object 20, being attached as hereinbefore described to the second section of line 18, is also thereby projected downwardly and serves to maintain the lower end cap 14 and attached end portion 18*b* of the second section of line 18 near the location to be marked, due to the weighted nature of the object 20. The reel 22, being attached to the second section of line 18, is also ejected downwardly away from the buoy tube 12 with the second section of line 18. The manner in which the respective ends of the first and second sections of line 17, 18 are attached to the same end of the reel 22 causes the reel to assume an approximately ninety-degree orientation relative to the second section of line 18 and thereby prevent the paying out of all of the line 18 over the conical end portion 44 thereof. The flotational capability of the buoy tube 12 and the added flotational capability of the foam plug 16 and its fitted position within the buoy tube 12, as hereinbefore described, permits the buoy tube 12 to rise and float on the surfaces S of the body of water W. The outer surface 24*b* of the buoy tube 12 can be any one of a variety of colors for easy discernment thereof on the surface S of the water W.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A portable buoy marker assembly, comprising:

(a) an elongated hollow buoy tube having a closed end and an opposite open end and being adapted for flotation in a body of water;

(b) an elongated flexible line substantially longer than said buoy tube and having a pair of opposite ends, said flexible line being attached at one of said ends thereof to said buoy tube and at the other of said ends extendable through said buoy tube and from said open end thereof;

(c) a reel attached to said flexible line nearer to said one end of said flexible line than to said other end thereof, said reel being adapted for winding a substantial portion of the length of said flexible line thereabout and being releasably received in said buoy tube through said open end thereof; and (d) an end cap releasably attached to said open end of said buoy tube to close said open end and retain said reel with said flexible line wound thereabout in a loosely contained and stored relationship within said buoy tube, said end cap being releasable from said buoy tube to open said open end of said buoy tube and permit said reel and said flexible line to release and fall away from said buoy tube through said open end thereof, said other of said ends of said flexible line being attached to said end cap.

2. The assembly of claim 1 further comprising:

an elongated foam body disposed in said buoy tube for providing additional flotational capability thereto.

3. The assembly of claim 1 further comprising:

a lanyard attached to and extending from said closed end of said buoy tube and extending through an aperture defined therein.

4. The assembly of claim 3 wherein said lanyard is in the form of a loop extending outwardly from said aperture in said closed end of said buoy tube, said lanyard being formed in a knot disposed within said buoy tube and against an interior portion thereof forming said aperture.

5. The assembly of claim 1 wherein said buoy tube is a hollow cylindrical body having a sidewall defining an internal cavity extending between said closed end and open end thereof.

6. The assembly of claim 5 further comprising:

an elongated foam body disposed in said buoy tube for providing additional flotational capability thereto.

7. The assembly of claim 6 wherein said foam body is positioned within said an upper end portion of said internal cavity of said buoy tube so as to abut an inner surface of said sidewall and be disposed adjacent to said closed end of said buoy tube.

8. The assembly of claim 6 further comprising:

a lanyard attached to and extending from said closed end of said buoy tube above said foam body and extending through an aperture defined therein.

9. The assembly of claim 1 wherein said reel has a middle portion for winding said substantial portion of the length of said flexible line thereabout and a pair of opposite end portions attached to opposite ends of said middle portion and being larger in diameter than said middle portion for maintaining said wound portion of said flexible line between said opposite end portions of said reel.

10. The assembly of claim 1 further comprising:

an elongated foam body disposed in said buoy tube for providing additional flotational capability thereto, said reel being disposed in said buoy tube adjacent to said foam body.

11. The assembly of claim 1 wherein a remaining portion of the length of said flexible line which extends from said reel to said end cap is positioned within said buoy tube between an end of said reel and said end cap.

12. The assembly of claim 11 further comprising:

a weighted object attached to said remaining portion of the length of said flexible line and positioned within said buoy tube between said end of said reel and said end cap.

13. A portable buoy marker assembly, comprising:

(a) an elongated hollow buoy tube having a closed end and an opposite open end, said tube having an aperture defined through said closed end;

(b) an elongated flotation plug disposed in said buoy tube for providing additional capability for flotation of said assembly in a body of water;

(c) an elongated flexible line substantially longer than said buoy tube and having a pair of opposite ends, said flexible line being attached at one of said ends thereof to said buoy tube and at the other of said ends extendable through said buoy tube and from said open end thereof;

(d) a flexible lanyard extending outwardly from said closed end of said buoy tube through an aperture defined in said closed end of said buoy tube;

(e) a reel attached to said flexible line nearer to said one end of said flexible line than to said other end thereof, said reel being adapted for winding a substantial portion of the length of said flexible line thereabout and being releasably receivable in said buoy tube through said open end thereof; and (f) an end cap releasably attached to said open end of said buoy tube to close said open end and retain said reel with said flexible line wound thereabout in a loosely contained and stored relationship within said buoy tube, said end cap being releasable from said buoy tube to open said open end of said buoy tube and permit said reel and said flexible line to release and fall away from said buoy tube through said open end thereof, said other of said ends of said flexible line being attached to said end cap.

14. The assembly of claim 13 wherein said lanyard is in the form of a loop extending outwardly from said aperture in said closed end of said buoy tube, said lanyard being formed in a knot disposed within said buoy tube and against an interior portion thereof forming said aperture.

15. The assembly of claim 13 wherein said reel has a middle portion for winding said substantial portion of the length of said flexible line thereabout and a pair of opposite end portions attached to opposite ends of said middle portion and being larger in diameter than said middle portion for maintaining said wound portion of said flexible line between said opposite end portions of said reel.

16. The assembly of claim 13 wherein said buoy tube is a hollow cylindrical body having a sidewall defining an internal cavity extending between said closed end and open end thereof.

17. The assembly of claim 16 wherein said flotation plug is positioned within an upper portion of said internal cavity of said buoy tube so as to abut an inner surface of said sidewall and be disposed adjacent to said closed end of said buoy tube.

18. The assembly of claim 17 wherein said reel being disposed in a lower portion of said internal cavity of said buoy tube adjacent to said flotation plug in said upper portion thereof.

19. The assembly of claim 18 wherein a remaining portion of the length of said flexible line which extends from said reel to said end cap is positioned within said buoy tube between an end of said reel and said end cap.

20. The assembly of claim 19 further comprising:

a weighted object attached to said remaining portion of the length of said flexible line and positioned within said buoy tube between said end of said reel and said end cap.

* * * * *